US005595195A

United States Patent [19]

Chang et al.

[11] Patent Number: 5,595,195

[45] Date of Patent: Jan. 21, 1997

[54] CIGARETTE WITH INSTALLED FIRE EXTINGUISHER

[76] Inventors: Cheng C. Chang; Cheeror Yang, both of No. 156, Ming Shen Street, Sansia, Taiwan

[21] Appl. No.: 603,945

[22] Filed: Feb. 20, 1996

[51] Int. Cl.[6] ..... A24D 1/10

[52] U.S. Cl. ..... 131/349

[58] Field of Search ..... 131/349, 360, 131/361, 364

[56] References Cited

U.S. PATENT DOCUMENTS

| | | | |
|---|---|---|---|
| 2,335,432 | 11/1943 | Millet | 131/349 |
| 2,718,889 | 9/1955 | Claussen | 131/349 |
| 3,091,243 | 5/1963 | Guida | 131/349 |
| 3,102,543 | 9/1963 | O'Siel et al. | 131/349 |
| 3,985,143 | 10/1976 | Lappin | 131/349 |
| 4,436,101 | 3/1984 | Seatts | 131/349 |

*Primary Examiner*—Jennifer Bahr
*Attorney, Agent, or Firm*—Pro-Techtor International

[57] ABSTRACT

A cigarette which includes a cylindrical collapsible water reservoir axially embedded in the filter-tip to hold water, an inflammable nozzle tube axially embedded in the tobacco within the outer paper tube of the cigarette and longitudinally connected to the cylindrical collapsible water reservoir, a collapsible metal ring movably mounted around the outer paper tube; water is released from the cylindrical collapsible water reservoir out of the inflammable nozzle tube to quench the flame during the burning of the tobacco, when the filter-tip is squeezed to compress the cylindrical collapsible water reservoir.

5 Claims, 2 Drawing Sheets

CIGARETTE WITH INSTALLED FIRE EXTINGUISHER

BACKGROUND OF THE INVENTION

The present invention relates to cigarettes, and relates more particularly to such a cigarette which has installed fire extinguisher means, which can be operated simply by a squeezing force to release water to quench the flame.

When stop smoking, the flame of the cigarette must be quenched. If the flame is not quenched when the cigarette is thrown away, a fire accident may occur. Various means for automatically extinguishing a cigarette have been disclosed. U.S. Pat. No. 3,985,143 discloses a self-extinguishing cigarette which has means for automatically extinguishing the cigarette when the cigarette has burned to a pre-determined position along its length, positioned at the required location within the tobacco and the paper tube (see FIG. 1). The sack of extinguishing means will be ruptured by the advancing heat of the burning tobacco and a sufficient quantity of water will be released to quench the flame. The main drawback of this structure of self-extinguishing cigarette is that the cigarette extinguishing means works only when the sack is ruptured by the advancing heat of the burning tobacco. U.S. Pat. No. 4,436,101 discloses another structure of self-extinguishing cigarette in which a compressible water container means is embedded within the filter-tip and extending into the compacted tobacco of the smoking-portion of the cigarette (see FIG. 2). The drawback of this structure of self-extinguishing cigarette is that the cigarette distinguishing means works only when the flame reaches the front end of the water container means. U.S. Pat. No. 4,979,522 discloses an automatic cigarette extinguishing apparatus which comprises a tank portion having a through hole through which a cigarette extends, the tank portion being located at an arbitrary position on a peripheral surface of the cigarette through the through hole and being made of a material having a melting temperature lower than a combustion temperature of tobacco; and extinguishing means stored in the tank portion, the tank portion being arranged to supply the extinguishing means to the tobacco upon combustion of the tobacco (see FIG. 3). This structure of automatic cigarette extinguishing apparatus is an independent accessory to be attached to the cigarette to be smoked. U.S. Pat. No. 5,174,309 discloses a cigarette with installed fire extinguisher which includes a fire extinguishing portion having a doughnut shape cross-section and including a thinner outer peripheral wall and a thicker inner peripheral wall which are radially spaced from each other to form a water storage between. When compressed, water is driven out of the fire extinguishing portion to quench the flame. This main drawback of this structure of cigarette with installed fire extinguisher is that water cannot be effectively driven to the burning end of the cigarette to quench the flame.

SUMMARY OF THE INVENTION

The present invention has been accomplished to provide a cigarette with installed fire extinguisher means which eliminates the aforesaid drawbacks. According to one aspect of the present invention, the fire extinguisher means includes a cylindrical collapsible water reservoir axially embedded in the filter-tip to hold water, an inflammable nozzle tube axially embedded in the tobacco within the outer paper tube of the cigarette and longitudinally connected to the cylindrical collapsible water reservoir, and a collapsible metal ring movably mounted around the outer paper tube. Water is released from the cylindrical collapsible water reservoir out of the inflammable nozzle tube to quench the flame during the burning of the tobacco, when the filter-tip is squeezed to compress the cylindrical collapsible water reservoir. According to another aspect of the present invention, the inflammable nozzle tube is made from tobacco, and internally threaded with a spiral thread. According to still another aspect of the present invention, the cylindrical collapsible water reservoir is sealed from the inflammable nozzle tube by a diaphragm, which will be ruptured to let water be released from the cylindrical collapsible water reservoir into the inflammable nozzle tube when said filter-tip is squeezed to compress the cylindrical collapsible water reservoir.

DETAILED DESCRIPTION OF THE PREFERRED EMBODIMENT

Figure 1:
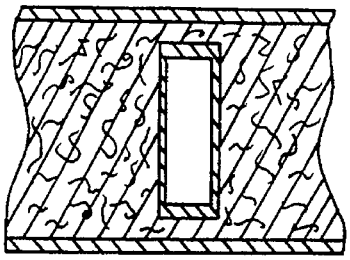
PRIOR ART FIG. 1
FIG. 1 shows a self extinguishing cigarette according to U.S. Pat. No. 3,985,143.
Figure 2:
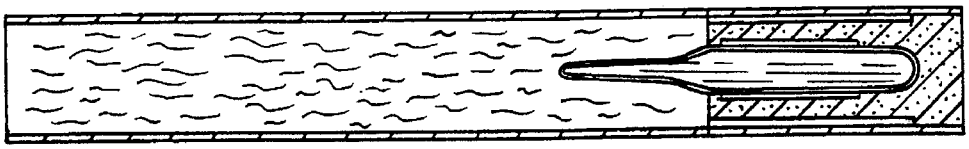
PRIOR ART FIG. 2
FIG. 2 shows a self-extinguishing cigarette according to U.S. Pat. No. 4,436,101.
Figure 3:
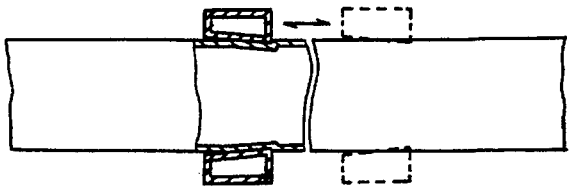
PRIOR ART FIG. 3
FIG. 3 shows an automatic cigarette extinguishing apparatus according to U.S. Pat. No. 4,979,522.
Figure 4:
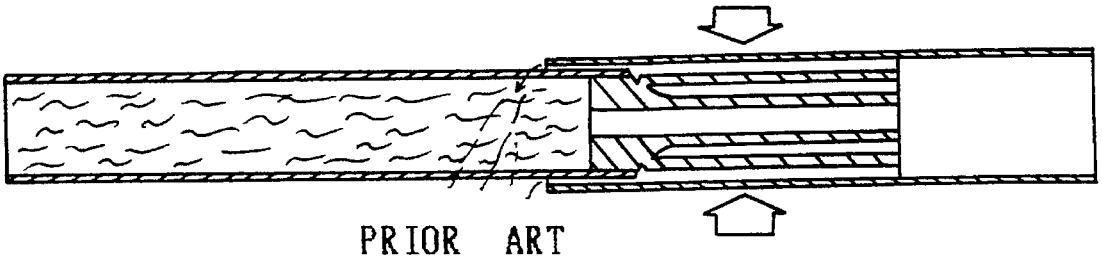
PRIOR ART FIG. 4
FIG. 4 shows a cigarette with installed fire extinguisher according to U.S. Pat. No. 5,174,309.
Figure 5:
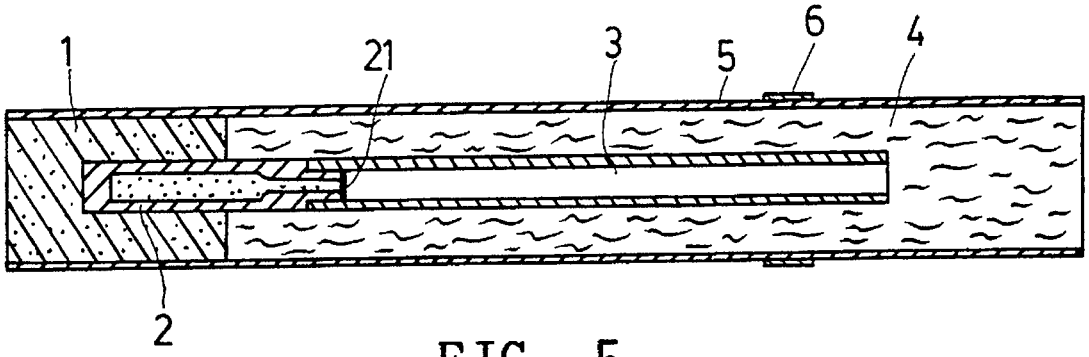
FIG. 5 is a longitudinal view in section of a cigarette with installed fire extinguisher means according to the present invention.

Referring to FIG. 5, a cigarette with installed fire extinguisher means in accordance with the present invention is generally comprised of a filter-tip 1, a cylindrical collapsible water reservoir 2, a diaphragm 21, an internally spirally threaded nozzle tube 3, a tobacco 4, an outer paper tube 5, and a collapsible metal ring 6. The cylindrical collapsible water reservoir 2 is mounted in the filter tip 1 at its longitudinal center axis, and longitudinally connected to the internally spirally threaded nozzle tube 3. The internally spirally threaded nozzle tube 3 is made from non-toxic paper or tobacco, and mounted in the tobacco 4 at its longitudinal central axis. The rear end of the internally spirally threaded nozzle tube 3 is connected to the front end of the cylindrical collapsible water reservoir 2. The diaphragm 21 is connected between the cylindrical collapsible water reservoir 2 and the internally spirally threaded nozzle tube 3 to seal the passage therebetween. The tobacco 4 is wrapped in the outer paper tube 5, which is longitudinally abutted against the periphery of the front end of the filter tip 1 in a flush manner. The collapsible metal ring 6 is slidably mounted around the paper tube 5.

Figure 6:
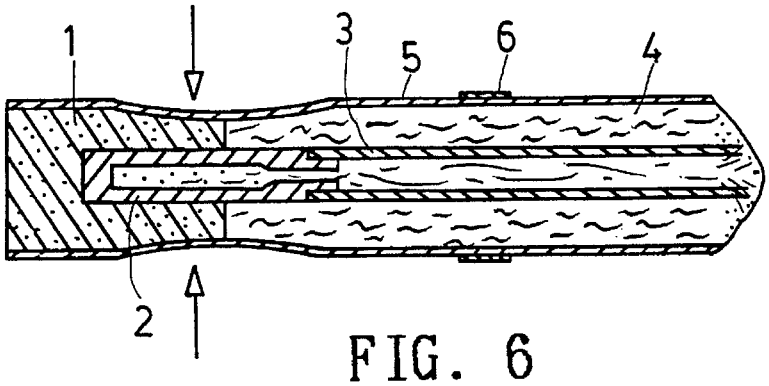
FIG. 6 is a partial view of the cigarette with installed fire extinguisher means shown in FIG. 5, showing the filter-tip squeezed and the cylindrical collapsible water reservoir compressed.
Figure 7:
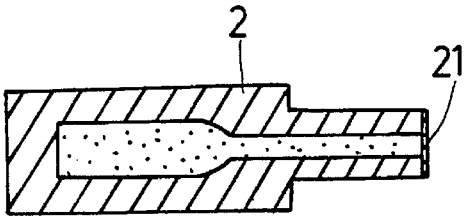
FIG. 7 is a sectional view in an enlarged scale of the cylindrical collapsible water reservoir according to the present invention.

Referring to FIGS. 6 and 7, and FIG. 5 again, when the outer paper tube 5 will be burnt by the heat of the burning tobacco. When the outer paper tube 5 is burnt to the length corresponding to the front end of the internally spirally threaded nozzle tube 3, the internally spirally threaded nozzle tube 3 will be synchronously burnt by the heat of the burning tobacco. When the filter-tip 1 is squeezed by hand, the cylindrical collapsible water reservoir 2 is compressed to give a forward pressure to the diaphragm 21, causing the diaphragm 21 to rupture, and therefore water is ejected from the cylindrical collapsible water reservoir 2 out of the nozzle tube 3 to quench the flame. Because the nozzle tube 3 is internally spirally threaded, the released water flows in a spiral way to quickly quench the flame.

Furthermore, the collapsible metal ring 6 is made from a thin sheet of metal, and slidably mounted around the outer paper tube 5 when the cigarette is manufactured. When smoking, the collapsible metal ring 6 can be moved toward the burning end of the cigarette to absorb the heat of the burning tobacco and to release the heat into the air. The collapsible metal ring 6 also supports the burning tobacco, and therefore cigarette ash does not fall from the burning tobacco easily. Because of the arrangement of the collapsible metal ring 6, less oxygen is supplied to the tobacco when the user stops sucking the burning cigarette, and the flame of the burning cigarette will be automatically quenched due to insufficient quantity of oxygen.

While only one embodiment of the present invention has been shown and described, it will be understood that various modifications and changes could be made without departing from the spirit and scope of the invention disclosed.

What the invention claimed is:

1. A cigarette of the type comprising a filter-tip, an outer paper tube connected to one end of said filter-tip in a flush manner, and a tobacco wrapped in said outer paper tube, wherein a cylindrical collapsible water reservoir is axially mounted in said filter-tip to hold water therein; an inflammable nozzle tube is axially mounted in said tobacco within said outer paper tube and longitudinally connected to said cylindrical collapsible water reservoir; a collapsible metal ring movably mounted around said outer paper tube; water is released from said cylindrical collapsible water reservoir out of said inflammable nozzle tube to quench the flame during the burning of said tobacco, when said filter-tip is squeezed to compress said cylindrical collapsible water reservoir.

2. The cigarette of claim 1 wherein said inflammable nozzle tube is made from tobacco.

3. The cigarette of claim 1 wherein said inflammable nozzle tube is made from non-toxic paper.

4. The cigarette of claim 1 wherein said inflammable nozzle tube is internally threaded with a spiral thread.

5. The cigarette of claim 1 wherein said cylindrical collapsible water reservoir is sealed from said inflammable nozzle tube by a diaphragm, which will be ruptured to let water be released from said cylindrical collapsible water reservoir into said inflammable nozzle tube when said filter-tip is squeezed to compress said cylindrical collapsible water reservoir.

* * * * *